US009134657B2

(12) United States Patent
Fujioka

(10) Patent No.: US 9,134,657 B2
(45) Date of Patent: Sep. 15, 2015

(54) IMAGE FORMING APPARATUS

(71) Applicant: Michio Fujioka, Nagoya (JP)

(72) Inventor: Michio Fujioka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/219,457

(22) Filed: Mar. 19, 2014

(65) Prior Publication Data

US 2014/0286661 A1 Sep. 25, 2014

(30) Foreign Application Priority Data

Mar. 19, 2013 (JP) ..... 2013-056725

(51) Int. Cl.

*G03G 15/09* (2006.01)
*G03G 15/16* (2006.01)
*G03G 15/01* (2006.01)

(52) U.S. Cl.

CPC ..... *G03G 15/1645* (2013.01); *G03G 15/0194* (2013.01); *G03G 2215/0141* (2013.01); *G03G 2215/0193* (2013.01)

(58) Field of Classification Search

CPC ..... G03G 15/1675; G03G 15/1665; G03G 2215/0138; G03G 2215/0141

See application file for complete search history.

(56) References Cited

U.S. PATENT DOCUMENTS

| | | | | |
|---|---|---|---|---|
| 6,356,732 | B1 * | 3/2002 | Watanabe et al. | 399/299 |
| 2007/0134028 | A1 | 6/2007 | Funabashi | |
| 2008/0025744 | A1 * | 1/2008 | Miyamoto et al. | 399/66 |
| 2008/0199196 | A1 * | 8/2008 | Cook | 399/66 |

FOREIGN PATENT DOCUMENTS

| | | | |
|---|---|---|---|
| JP | 2002-049214 | A | 2/2002 |
| JP | 2003-057918 | A | 2/2003 |
| JP | 2006-058351 | A | 3/2006 |
| JP | 2007-163838 | A | 6/2007 |

* cited by examiner

*Primary Examiner* — Clayton E Laballe
*Assistant Examiner* — Ruifeng Pu
(74) *Attorney, Agent, or Firm* — Banner & Witcoff, Ltd.

(57) ABSTRACT

An image forming apparatus is provided, which includes photoconductive drums arranged along a sheet conveyance direction, transfer bodies each disposed to face a corresponding one of the photoconductive drums, a fuser unit disposed downstream relative to a most downstream photoconductive drum in the sheet conveyance direction and configured to feed a sheet at a feeding speed lower than a feeding speed of the most downstream photoconductive drum, and a controller configured to, when the sheet is not in contact with any photoconductive drum but the most downstream photoconductive drum, perform a specific voltage applying mode to apply, to a most downstream transfer body in the sheet conveyance direction, a higher voltage than when the sheet is in contact with two or more photoconductive drums.

10 Claims, 2 Drawing Sheets

IMAGE FORMING APPARATUS

CROSS-REFERENCE TO RELATED APPLICATION

This application claims priority under 35 U.S.C. §119 from Japanese Patent Application No. 2013-056725 filed on Mar. 19, 2013. The entire subject matter of the application is incorporated herein by reference.

BACKGROUND

1. Technical Field

The following description relates to one or more techniques for an electrophotography-type image forming apparatus that includes a plurality of photoconductive drums arranged along a sheet conveyance direction.

2. Related Art

A technique has been proposed to prevent a discharge phenomenon from occurring when a sheet is separated from a transfer belt. In this technique, a voltage applied to a transfer body corresponding to the most upstream one of a plurality of photoconductive drums arranged along a sheet conveyance direction is set higher than voltages applied to the other transfer bodies.

SUMMARY

When developer images are transferred onto a sheet from the photoconductive drums in a situation where the sheet is excessively pulled downstream in the sheet conveyance direction, it is likely that the developer images transferred onto the sheet might be deteriorated. Therefore, in general, an electrophotography-type image forming apparatus is configured to set a sheet feeding speed at a fuser unit lower than a sheet feeding speed at the photoconductive drums, so as to prevent the sheet from being excessively pulled downstream in the sheet conveyance direction.

In the meantime, the inventor of the present invention has found that the developer images transferred onto the sheet might be deteriorated by a different cause from the aforementioned one. That is, since the sheet feeding speed at the fuser unit is lower than the sheet feeding speed at transfer bodies, when a single sheet is in contact with the fuser unit and at least one transfer body, the single sheet is bent in a manner buckling in the sheet conveyance direction. Then, by a restoring force of the bent sheet, a trailing end of the sheet in the sheet conveyance direction is urged to move upstream in the sheet conveyance direction.

When the sheet is in contact with two or more photoconductive drums, the trailing end of the sheet is attracted by two or more transfer bodies. Therefore, a large attractive force is applied to the sheet. It is noted that the attractive force applied to the sheet is an electrostatic attractive force generated when the transfer bodies are supplied with voltages.

However, when the sheet is not in contact with any drum but the most downstream one of the plurality of photoconductive drums in the sheet conveyance direction, the attractive force applied to the sheet is lower than when the sheet is in contact with two or more photoconductive drums.

When the developer image is transferred onto the sheet from the most downstream photoconductive drum in a situation where the restoring force of the sheet is larger than the attractive force applied to the sheet, the trailing end of the sheet moves upstream in the sheet conveyance direction.

Thus, the inventor has found a new problem that when the sheet is not in contact with any drum but the most downstream photoconductive drum in the sheet conveyance direction, the developer image transferred onto the sheet is more likely to be deteriorated than when the sheet is in contact with two or more photoconductive drums. The same problem applies to an image forming apparatus of a beltless type without any transfer belt.

Aspects of the present invention are advantageous to provide one or more improved techniques, for an image forming apparatus, which make it possible to overcome the aforementioned problem.

According to aspects of the present invention, an image forming apparatus is provided that is configured to electrophotographically form an image on a sheet, the image forming apparatus including a plurality of photoconductive drums arranged along a sheet conveyance direction, each photoconductive drum configured to carry a developer image to be transferred onto the sheet, a plurality of transfer bodies each disposed to face a corresponding one of the plurality of photoconductive drums, each transfer body configured to transfer, onto the sheet, the developer image carried on the corresponding photoconductive drum, a fuser unit disposed downstream relative to a most downstream one of the plurality of photoconductive drums in the sheet conveyance direction, the fuser unit configured to feed the sheet at a feeding speed lower than a feeding speed of the most downstream photoconductive drum, and a controller configured to, when the sheet is not in contact with any photoconductive drum but the most downstream photoconductive drum, perform a specific voltage applying mode to apply, to a most downstream transfer body, a higher voltage than when the sheet is in contact with two or more photoconductive drums, the most downstream transfer body being a most downstream one of the plurality of transfer bodies in the sheet conveyance direction, the most downstream transfer body disposed to face the most downstream photoconductive drum.

According to aspects of the present invention, further provided is an image forming apparatus configured to electrophotographically form an image on a sheet, the image forming apparatus including a plurality of photoconductive drums arranged along a sheet conveyance direction, each photoconductive drum configured to carry a developer image to be transferred onto the sheet, a plurality of transfer bodies each disposed to face a corresponding one of the plurality of photoconductive drums, each transfer body configured to transfer, onto the sheet, the developer image carried on the corresponding photoconductive drum, a fuser unit disposed downstream relative to a most downstream one of the plurality of photoconductive drums in the sheet conveyance direction, the fuser unit configured to feed the sheet at a feeding speed lower than a feeding speed of the most downstream photoconductive drum, a detector disposed at a detecting portion upstream relative to a most upstream one of the plurality of photoconductive drums in the sheet conveyance direction, the detector configured to detect whether the sheet is present at the detecting portion, a voltage applying unit configured to apply voltages to the plurality of transfer bodies, and a controller configured to start a specific voltage applying mode when determining that the sheet is not in contact with any photoconductive drum but the most downstream photoconductive drum, and the most downstream photoconductive drum comes into contact with an image-formable area of the sheet, based on a detection result of the detector, wherein, in the specific voltage applying mode, the controller controls the voltage applying unit to apply to a most downstream transfer body a higher voltage than when the sheet is in contact with two or more photoconductive drums, the most downstream transfer body being a most downstream one of the plurality of transfer bodies in the sheet conveyance direction, the most downstream transfer body disposed to face the most downstream photoconductive drum.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompanying drawings. It is noted that, in the embodiment, aspects of the present invention are applied to a direct-type image forming apparatus configure to directly form an image on a sheet such as a recording paper. Further, in the following descriptions, a front side, a rear side, an upside, and a downside will be defined as shown in the accompanying drawings.

1. General Overview of Image Forming Apparatus

Figure 1:
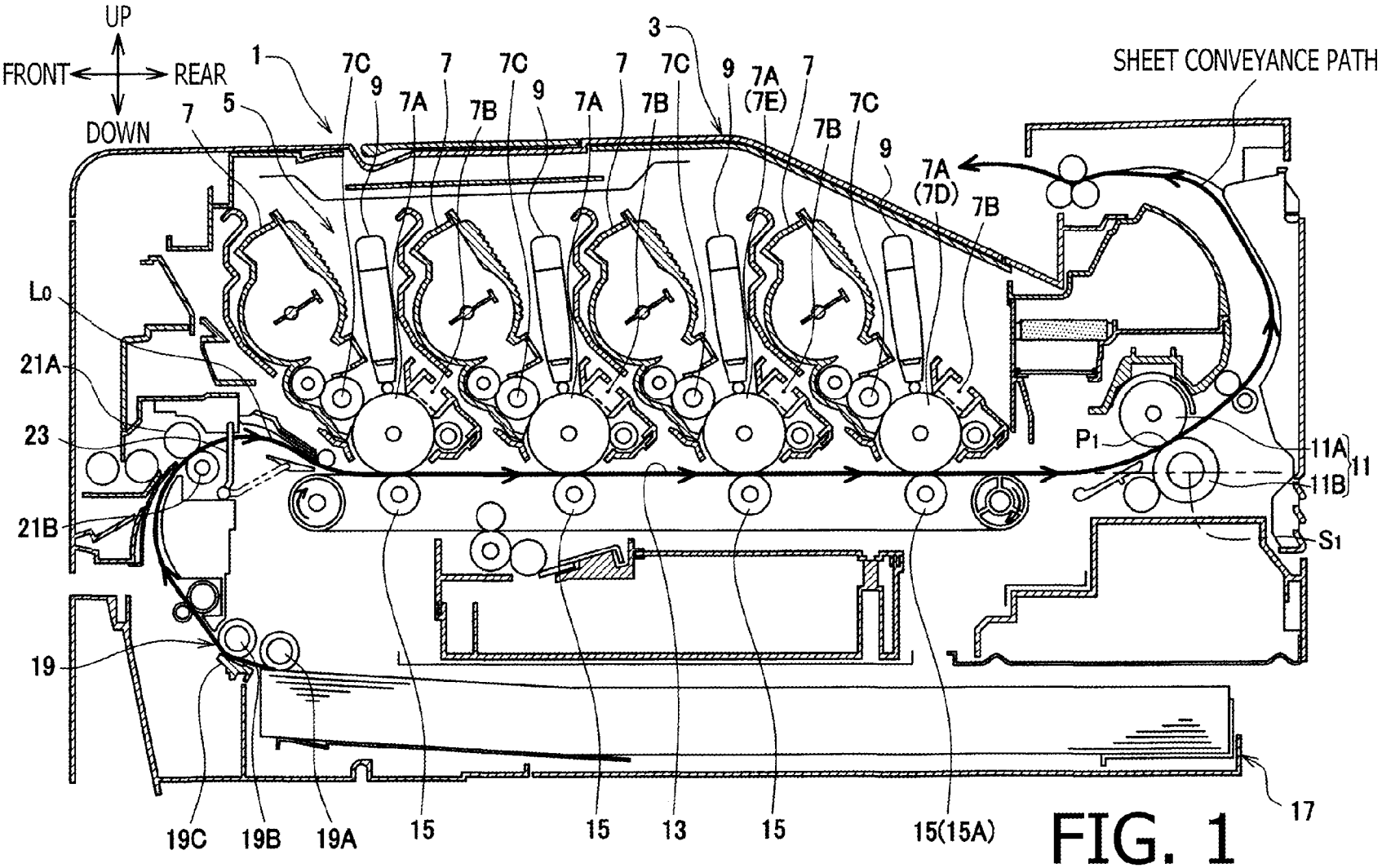
FIG. 1 is a cross-sectional view schematically showing an internal configuration of an image forming apparatus in an embodiment according to one or more aspects of the present invention.

As shown in FIG. 1, in a housing 3 of an image forming apparatus 1, incorporated is an electrophotography type image forming unit 5 configured to form an image on a sheet. The image forming unit 5 includes a plurality of process cartridges 7, a plurality of exposure units 9, and a fuser unit 11.

The process cartridges 7 are arranged along a direction perpendicular to an axial direction of below-mentioned photoconductive drums 7A. Therefore, the direction along which the process cartridges 7 are arranged is coincident with a sheet conveyance direction.

The process cartridges 7, for respective four colors, are arranged in an order of yellow, magenta, cyan, and black from an upstream side in the sheet conveyance direction. Each process cartridge 7 is detachably attached to an apparatus main body. Each process cartridge 7 includes a photoconductive drum 7A, a charger 7B, and a development unit 7C.

It is noted that the apparatus main body represents an unreplaceable part, of the image forming apparatus 1, which is not able to be detached or exchanged by a user, and includes, for instance, the housing 3 and a main frame (not shown). The main frame includes two plate-shaped members spaced apart from each other in a width direction.

Each photoconductive drum 7A is configured to carry a developer image to be transferred onto a sheet. Each charger 7B is configured to charge the corresponding photoconductive drum 7A. Each exposure unit 9 is configured to expose the charged photoconductive drum 7A and form an electrostatic latent image on the photoconductive drum 7A.

Each development unit 7C is configured to supply development agent onto the photoconductive drum 7A and form a developer image corresponding to the electrostatic latent image. It is noted that the photoconductive drums 7A, each of which has an axial direction perpendicular to the sheet conveyance direction, are arranged along the sheet conveyance direction.

A belt 13 is configured to convey a sheet. Specifically, the belt 13 is an endless belt configured to turn in contact with a sheet, so as to provide a conveyance force to the sheet. There are transfer bodies 15 each disposed to face the corresponding photoconductive drum 7A across the belt 13.

Each transfer body 15 is configured to cause the developer image carried on the corresponding photoconductive drum 7A to be transferred onto a sheet being conveyed on the belt 13. Thus, the developer images carried on the photoconductive drums 7A are sequentially transferred onto the sheet in a superimposed manner.

Each transfer body 15 is a roller including an outer circumferential surface made of a porous elastic body such as sponge. Each transfer body 15 is supplied with a voltage that generates electric charges with a polarity opposite to a polarity of the charged developer image. Therefore, the developer image carried on each photoconductive drum 7A is attracted by an electrostatic attractive force of the corresponding transfer body 15, and is transferred onto the sheet.

The fuser unit 11 is disposed downstream relative to the most downstream one (7D) of the plurality of photoconductive drums 7A in the sheet conveyance direction. The fuser unit 11 is configured to fix the developer images transferred onto the sheet.

The fuser unit 11 includes a heating roller 11A and a pinch roller 11B. The heating roller 11A is configured to heat and fix the developer images transferred onto the sheet. The pinch roller 11B is configured to press the sheet against the heating roller 11A.

A circumferential velocity of the heating roller 11A and the pinch roller 11B is lower than a circumferential velocity of the most downstream photoconductive drum 7D. Namely, the fuser unit 11 is configured to feed the sheet at a sheet feeding speed lower than a sheet feeding speed of the most downstream photoconductive drum 7D.

A contact portion where the sheet contacts the fuser unit 11, that is, a nipping portion P1 between the heating roller 11A and the pinch roller 11B is out of a virtual tangential plane S1 (upward) in a direction perpendicular to the virtual tangential plane S1. The virtual tangential plane S1 is a virtual plane that is tangential in common to the most downstream photoconductive drum 7D and the second most downstream photoconductive drum 7E (which is adjacent to the most downstream photoconductive drum 7D).

Specifically, the nipping portion P1 is located in a position shifted out of the virtual tangential plane S1 toward the photoconductive drums 7A in the direction perpendicular to the virtual tangential plane S1 (i.e., a substantially vertical direction). Namely, in the embodiment, the nipping portion P1 is disposed above the virtual tangential plane S1. It is noted that the virtual tangential plane S1 is a virtual plane that contains the sheet being conveyed in contact with the photoconductive drums 7A.

There is a feeder mechanism 19 disposed upstream in the sheet conveyance direction relative to the belt 13. The feeder mechanism 19 is configured to feed sheets placed on a feed tray 17 toward the image forming unit 5 on a sheet-by-sheet basis.

The feed tray 17 is configured to support sheets to be fed to the image forming unit 5. Further, the feed tray 17 is detachably attached to the apparatus main body. The feeder mechanism 19 includes a pickup roller 19A, a separation roller 19B, and a separation pad 19C.

The pickup roller 19A is configured to rotate in contact with a sheet placed on the feed tray 17, so as to provide a feeding force to the sheet. The separation roller 19B is configured to separate a plurality of sheets fed together in a stacked manner from the pickup roller 19A, in cooperation with the separation pad 19C, so as to sequentially feed the plurality of sheets on a sheet-by-sheet basis.

There are two registration rollers 21A and 21B disposed upstream in the conveyance direction relative to the belt 13. The two registration rollers 21A and 21B are configured to temporarily stop feeding of a sheet fed from the feeder mechanism 19, and thereafter feed the sheet toward the photoconductive drums 7A. Thereby, the sheet, after skew correction has been implemented therefor, is conveyed into the image forming unit 5 in accordance with predetermined timing.

There is a detector 23 disposed on a conveyance path Lo that extends from the two registration rollers 21A and 21B to the belt 13. The detector 23 is configured to detect a leading end (in the sheet conveyance direction) of a sheet passing through the detector 23 and detect a moment (timing) at which the leading end of the sheet passes through the detector 23.

Namely, the detector 23 is disposed, on the conveyance path Lo, in a position upstream relative to the most upstream one of the plurality of photoconductive drums 7A in the conveyance direction. Further, the detector 23 is configured to detect whether there is a sheet on the conveyance path Lo.

2. Control of Electricity Supply to Transfer Bodies

Figure 2:
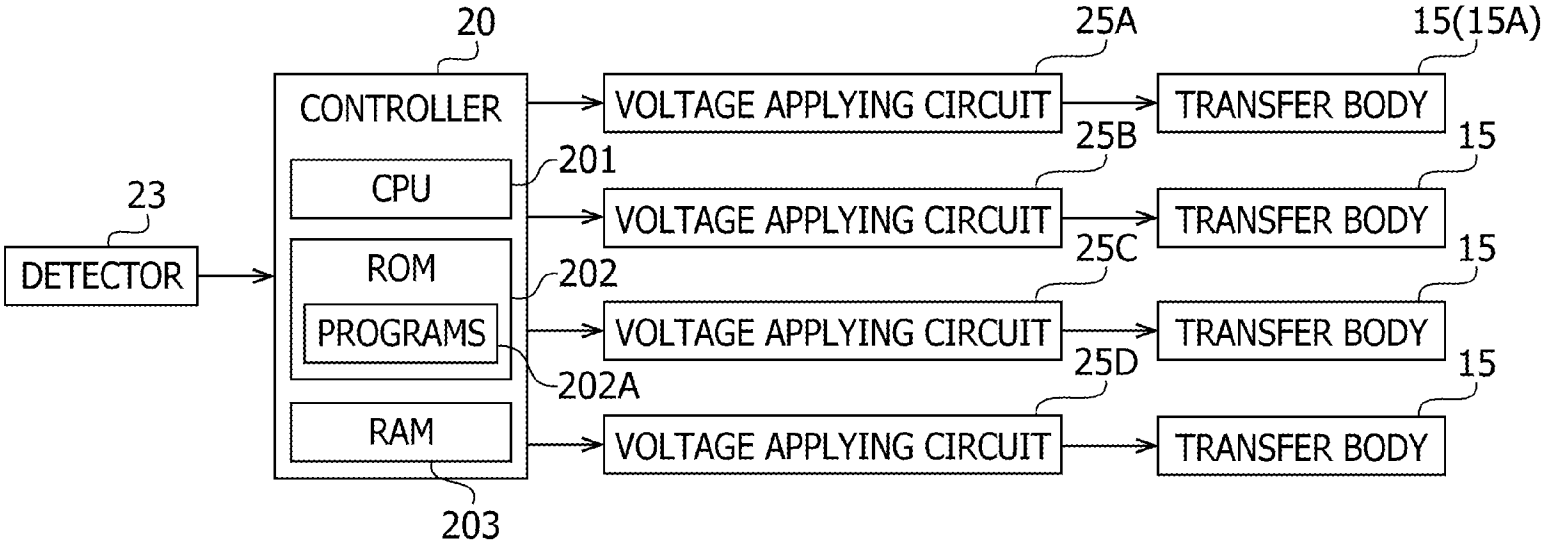
FIG. 2 is a block diagram schematically showing a configuration of a control system for controlling voltage supply to each transfer body in the image forming apparatus in the embodiment according to one or more aspects of the present invention.

In the embodiment, as shown in FIG. 2, each of voltage applying circuits 25A, 25B, 25C, and 25D is provided for a corresponding one of the transfer bodies 15, and configured to apply a voltage to the corresponding transfer body 15. The voltage applying circuit 25A is configured to apply a voltage to the most downstream transfer body 15A in the sheet conveyance direction.

A voltage value and voltage applying timing of each voltage applying circuit 25A to 25D are controlled by a controller 20. The controller 20 is a microcomputer that includes a CPU 201, a ROM 202, and a RAM 203. Programs 202A for controlling the voltage applying circuits 25A to 25D are previously stored in a nonvolatile storage device such as the ROM 202.

The controller 20 controls each of the voltage applying circuits 25A to 25D to apply a voltage to the corresponding transfer body 15 only when a sheet is in contact with the corresponding photoconductive drum 7A. Namely, for instance, when a sheet begins to contact the most downstream photoconductive drum 7D, the controller 20 starts controlling the voltage applying circuit 25A to apply a voltage to the most downstream transfer body 15A.

Then, when the sheet completely passes through the most downstream photoconductive drum 7D and comes into a non-contact state where the sheet does not contact the most downstream photoconductive drum 7D, the controller 20 controls the voltage applying circuit 25A to stop applying a voltage to the most downstream transfer body 15A. The controller 20 determines start timing to start the voltage supply to each transfer body 15 and stop timing to stop the voltage supply to each transfer body 15, based on a detection result of the detector 23.

Specifically, based on a time measured on the basis of the timing (at which the leading end of the sheet passes through the detector 23) detected by the detector 23, the controller 20 determines a position of the leading end of the sheet and a length of the sheet. Further, the controller 20 determines which drum(s) of the plurality of photoconductive drums 7A is (are) in contact with the sheet.

The controller 20 performs a voltage applying mode A when the sheet is not in contact with any drum but the most downstream photoconductive drum 7D. In the voltage applying mode A, the controller 20 controls the voltage applying circuit 25A to apply a higher voltage to the most downstream transfer body 15 than when the sheet is in contact with two or more photoconductive drums 7A. The voltage applying mode A is performed only for the most downstream transfer body 15A.

That is, in the situation where the sheet is not in contact with any drum but the most downstream drum 7D, the controller 20 stops the voltage supply to the transfer bodies 15 other than the most downstream transfer body 15A. Then, the controller 20 starts the voltage applying mode A when (determining that) the sheet is not in contact with any drum but the most downstream photoconductive drum 7D, and the most downstream photoconductive drum 7D comes into contact with an image-formable area of the sheet. Afterward, the controller 20 stops the voltage supply to the most downstream transfer body 15A when the sheet comes into a non-contact state where the image-formable area thereof is not in contact with the most downstream photoconductive drum 7D.

It is noted that "the image-formable area of the sheet" is an area, other than margins, of the sheet where an image can be formed. The controller 20 determines whether the most downstream photoconductive drum 7D is in contact with the image-formable area of the sheet, based on the detection result of the detector 23.

3. Features of Image Forming Apparatus in Embodiment

In the embodiment, when the sheet is not in contact with any drum but the most downstream photoconductive drum, a higher voltage is applied to the most downstream transfer body 15A than when the sheet is in contact with two or more photoconductive drums 7A.

Thereby, in the embodiment, it is possible to prevent the attractive force applied to the sheet from being drastically lowered when the sheet is not in contact with any drum but the most downstream photoconductive drum 7D. Accordingly, it is possible to prevent a trailing end portion of the sheet from moving to an upstream side in the sheet conveyance direction when the developer image is transferred onto the sheet from the most downstream photoconductive drum 7A. Thus, it is possible to prevent deterioration of an image formed on the sheet.

In the meantime, the aforementioned voltage applying mode A may be implemented for all the transfer bodies 15 when the sheet is not in contact with any drum but the most downstream photoconductive drum 7D. However, in the embodiment, the voltage applying mode A is performed only for the most downstream transfer body 15A, which is disposed to face the most downstream photoconductive drum 7D. Thereby, it is possible to prevent applying of unnecessary voltages.

In the embodiment, the detector 23, configured to detect whether there is a sheet, is disposed at a portion upstream in the sheet conveyance direction relative to the most upstream one of the plurality of photoconductive drums 7A. Further, the controller 20 determines the timing to start the voltage applying mode A, based on the detection result of the detector 23. Thereby, it is possible to accurately determine the timing to start the voltage applying mode A.

In the embodiment, the controller 20 preforms the voltage applying mode A when (determining that) the sheet is not in contact with any drum but the most downstream photoconductive drum 7D, and the most downstream photoconductive drum 7D is in contact with the image-formable area of the sheet. Thereby, it is possible to prevent applying of an unnecessary voltage.

In the embodiment, the nipping portion P1, where the sheet contacts the fuser unit 11, is out of the virtual tangential plane S1 in the direction perpendicular to the virtual tangential plane S1.

Thereby, in the embodiment, the sheet, which is not in contact with any drum but the most downstream photoconductive drum 7D, is pressed by a restoring force of the (bent) sheet against the most downstream photoconductive drum 7D or the transfer body 15A. Accordingly, it is possible to heighten a frictional force between the sheet and the transfer body 15A or a frictional force between the sheet and the most downstream photoconductive drum 7D. Thus, owing to the heightened frictional force, it is possible to prevent the trailing end of the sheet from moving to the upstream side in the sheet conveyance direction.

Further, in the embodiment, the nipping portion P1, where the sheet contacts the fuser unit 11, is located in a position shifted out of the virtual tangential plane S1 toward the photoconductive drums 7A in the direction perpendicular to the virtual tangential plane S1. Therefore, the sheet, which is not in contact with any drum but the most downstream photoconductive drum 7D, is pressed by the restoring force against the transfer body 15A.

In the embodiment, the image forming apparatus 1 includes the belt 13 configured to convey the sheet thereon. Thereby, the sheet, which is sticking onto the belt 13, moves together with the belt 13. Thus, it is possible to prevent the trailing end of the sheet, which is sticking onto the belt 13, from moving to the upstream side in the sheet conveyance direction.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

Modifications

In the aforementioned embodiment, aspects of the present invention are applied to the image forming apparatus 1 including the belt 13. However, aspects of the present invention may be applied to an image forming apparatus without a belt.

In the aforementioned embodiment, the timing to start the voltage applying mode A is controlled by utilizing the timing (at which the leading end of the sheet passes through the detector 23) detected by the detector 23. Nonetheless, the timing to start the voltage applying mode A may be controlled in any other method.

In the aforementioned embodiment, the image forming apparatus 1 includes voltage applying circuits 21A, 21B, 21C, and 21D each provided for a corresponding one of the plurality of transfer bodies 15. However, the image forming apparatus 1 may include one or more voltage applying circuits each provided for two or more transfer bodies 15.

In the aforementioned embodiment, the voltage applying mode A is performed only for the most downstream transfer body 15. Nonetheless, for instance, when the sheet is not in contact with any drum but the most downstream photoconductive drum 7D, each of the transfer bodies 15 may be supplied with a higher voltage than when the sheet is in contact with two or more photoconductive drums 7A.

What is claimed is:

1. An image forming apparatus configured to electrophotographically form an image on a sheet, comprising:

a plurality of photoconductive drums arranged along a sheet conveyance direction, each photoconductive drum configured to carry a developer image to be transferred onto the sheet;

a plurality of transfer bodies each disposed to face a corresponding one of the plurality of photoconductive drums, each transfer body configured to transfer, onto the sheet, the developer image carried on the corresponding photoconductive drum;

a fuser unit disposed downstream relative to a most downstream one of the plurality of photoconductive drums in the sheet conveyance direction, the fuser unit configured to feed the sheet at a feeding speed lower than a feeding speed of the most downstream photoconductive drum; and a controller configured to, when the sheet is not in contact with any photoconductive drum but the most downstream photoconductive drum, perform a specific voltage applying mode to apply, to a most downstream transfer body, a higher voltage than a voltage applied to the most downstream transfer body when the sheet is in contact with two or more photoconductive drums, the most downstream transfer body being a most downstream one of the plurality of transfer bodies in the sheet conveyance direction, the most downstream transfer body disposed to face the most downstream photoconductive drum.

2. The image forming apparatus according to claim 1, wherein the controller is further configured to perform the specific voltage applying mode only for the most downstream transfer body.

3. The image forming apparatus according to claim 1, further comprising a detector disposed at a detecting portion upstream of a most upstream one of the plurality of photoconductive drums in the sheet conveyance direction, the detector configured to detect whether the sheet is present at the detecting portion, wherein the controller is further configured to determine a timing to start the specific voltage applying mode, based on a detection result of the detector.

4. The image forming apparatus according to claim 1, wherein the controller is further configured to perform the specific voltage applying mode when the sheet is not in contact with any photoconductive drum but the most downstream photoconductive drum, and the most downstream photoconductive drum is in contact with an image-formable area of the sheet.

5. The image forming apparatus according to claim 1, wherein a contact portion where the sheet contacts the fuser unit is located in a position shifted out of a virtual tangential plane in a direction perpendicular to the virtual tangential plane, the virtual tangential plane being tangential to the most downstream photoconductive drum and a photoconductive drum adjacent to the most downstream photoconductive drum.

6. The image forming apparatus according to claim 5, wherein the contact portion where the sheet contacts the fuser unit is located in a position shifted out of the virtual tangential plane toward the plurality of photoconductive drums in the direction perpendicular to the virtual tangential plane.

7. The image forming apparatus according to claim 1, further comprising an endless belt disposed between the plurality of photoconductive drums and the plurality of transfer bodies, the endless belt configured to convey the sheet.

8. The image forming apparatus according to claim 1, further comprising a voltage applying unit configured to apply voltages to the plurality of transfer bodies, wherein the controller is further configured to:

control the voltage applying unit to apply a voltage to a specific transfer body only when the sheet is in contact with the photoconductive drum disposed to face the specific transfer body; and perform, when the sheet is not in contact with any photoconductive drum but the most downstream photoconductive drum, the specific voltage applying mode in which the controller controls the voltage applying unit to apply, to the most downstream transfer body, a higher voltage than when the sheet is in contact with two or more photoconductive drums.

9. The image forming apparatus according to claim 8, wherein the controller comprises:

a memory; and a processor configured to control the voltage applying unit when executing processor-executable instructions stored in the memory.

10. An image forming apparatus configured to electrophotographically form an image on a sheet, comprising:

a plurality of photoconductive drums arranged along a sheet conveyance direction, each photoconductive drum configured to carry a developer image to be transferred onto the sheet;

a plurality of transfer bodies each disposed to face a corresponding one of the plurality of photoconductive drums, each transfer body configured to transfer, onto the sheet, the developer image carried on the corresponding photoconductive drum;

a fuser unit disposed downstream relative to a most downstream one of the plurality of photoconductive drums in the sheet conveyance direction, the fuser unit configured to feed the sheet at a feeding speed lower than a feeding speed of the most downstream photoconductive drum;

a detector disposed at a detecting portion upstream relative to a most upstream one of the plurality of photoconductive drums in the sheet conveyance direction, the detector configured to detect whether the sheet is present at the detecting portion;

a voltage applying unit configured to apply voltages to the plurality of transfer bodies; and a controller configured to start a specific voltage applying mode when determining that the sheet is not in contact with any photoconductive drum but the most downstream photoconductive drum, and the most downstream photoconductive drum comes into contact with an image-formable area of the sheet, based on a detection result of the detector, wherein, in the specific voltage applying mode, the controller controls the voltage applying unit to apply to a most downstream transfer body a higher voltage than a voltage applied to the most downstream transfer body when the sheet is in contact with two or more photoconductive drums, the most downstream transfer body being a most downstream one of the plurality of transfer bodies in the sheet conveyance direction, the most downstream transfer body disposed to face the most downstream photoconductive drum.

* * * * *